United States Patent [19]

Bancalari

[11] 4,417,223

[45] Nov. 22, 1983

[54] MULTIPOLE ELECTRIC CIRCUIT BREAKER WITH IMPROVED CURRENT LIMITING DEVICE

[75] Inventor: Jean Bancalari, Grenoble, France

[73] Assignee: Merlin Gerin, Grenoble, France

[21] Appl. No.: 346,139

[22] Filed: Feb. 5, 1982

[30] Foreign Application Priority Data

Feb. 11, 1981 [FR] France ..... 81 02800

[51] Int. Cl.[3] ..... H01H 77/10

[52] U.S. Cl. ..... 335/195; 335/16

[58] Field of Search ..... 335/16, 195

[56] References Cited

U.S. PATENT DOCUMENTS 3,614,687 10/1971 Iida ..... 335/195

FOREIGN PATENT DOCUMENTS 177827 of 0000 Austria .

1665817 of 0000 Fed. Rep. of Germany .

2351483 of 0000 France .

*Primary Examiner*—Harold Broome

*Attorney, Agent, or Firm*—Parkhurst & Oliff

[57] ABSTRACT

Current limiting circuit breaker having a plurality of movable parallel contact arms vigorously moved in the open circuit position by electrodynamic repulsive forces at the appearance of a short-circuit current. The opening movement of one of said contact arms is limited by an abutment and the movement of the other contact arms is limited by a lost motion mechanical linkage connecting together said contact arms so as to delay the reclosure and to prevent a reclosing before tripping of the circuit breaker.

4 Claims, 2 Drawing Figures

MULTIPOLE ELECTRIC CIRCUIT BREAKER WITH IMPROVED CURRENT LIMITING DEVICE

This invention relates to a low voltage, multipole current limiting circuit breaker having a number of movable parallel contact arms, each arm subject to high-speed opening through electrodynamic autorepulsive forces under the effect of a sudden increase in current, and a braking component cooperating at the end of the opening travel with the aforementioned contact arms so that the opening time during the autorepulsion phase will be greater than the response time of the tripping unit.

A current limiting device of the type mentioned is described in U.S. Pat. No. 4,118,681, in which each pole has its own inertia block of predetermined weight, linked mechanically to the mobile contact by an idle-travel mechanical link, and able to execute a limited movement in relation to said mobile contact. There is one biasing spring associated with the mechanical link, and a second pressure contact spring bearing on the mobile contact in the closed position. The high speed movement of the mobile contact into the open position is achieved by means of an auxiliary magnetic circuit with a narrow gap surrounding at least one current carrying conductor. The use of such a braking component with a current limiting circuit breaker for high ratings, for instance 1000 A, comprising a large number of mobile contacts with high speed opening through electrodynamic autorepulsive forces for each pole, entails problems in functioning and problems of space inside the insulating box of the circuit breaker.

The object of the present invention is to achieve a high rating current limiting circuit breaker equipped with a simple and reliable, inertia-type braking component.

According to the invention, the braking component has an inertia block formed by one contact arm, connected by a lost motion travel mechanical linkage to a second adjacent contact arm cooperating in the open position with a stop, arranged so that it prevents the movement of the second arm beyond the open position and so that it allows the continued movement of the first adjacent arm until it reaches the end of the idle travel of the mechanical linkage, the inertia of the first arm then compensating the impact when the second arm and the stop come into contact, in order to prevent immediate reclosure of the contact arms before the tripping unit operates.

The inertia of at least one mobile contact arm is used to constitute the inertia block of the braking component.

According to one embodiment of the invention, the said mechanical linkage comprises a drive component fixed to the second contact arm associated with the stop and cooperating with clearance with the first adjacent inertia block arm capable of restricted movement during the said idle travel.

According to another embodiment of the invention, the drive component of the mechanical linkage comprises a lock-pin attached to the second contact arm and lying in a transverse direction through an opening provided in the first adjacent contact arm, the diameter of the opening being larger than that of the pin to provide the aforementioned idle travel. The lock-pin is advantageously attached to an intermediate second contact arm, inserted between the first and a third contact arm of identical design. Other advantages and features will be more clearly apparent from the following description of a mode of construction furnished as a non-exhaustive example, and illustrated in the attached drawings in which:

Figure 1:
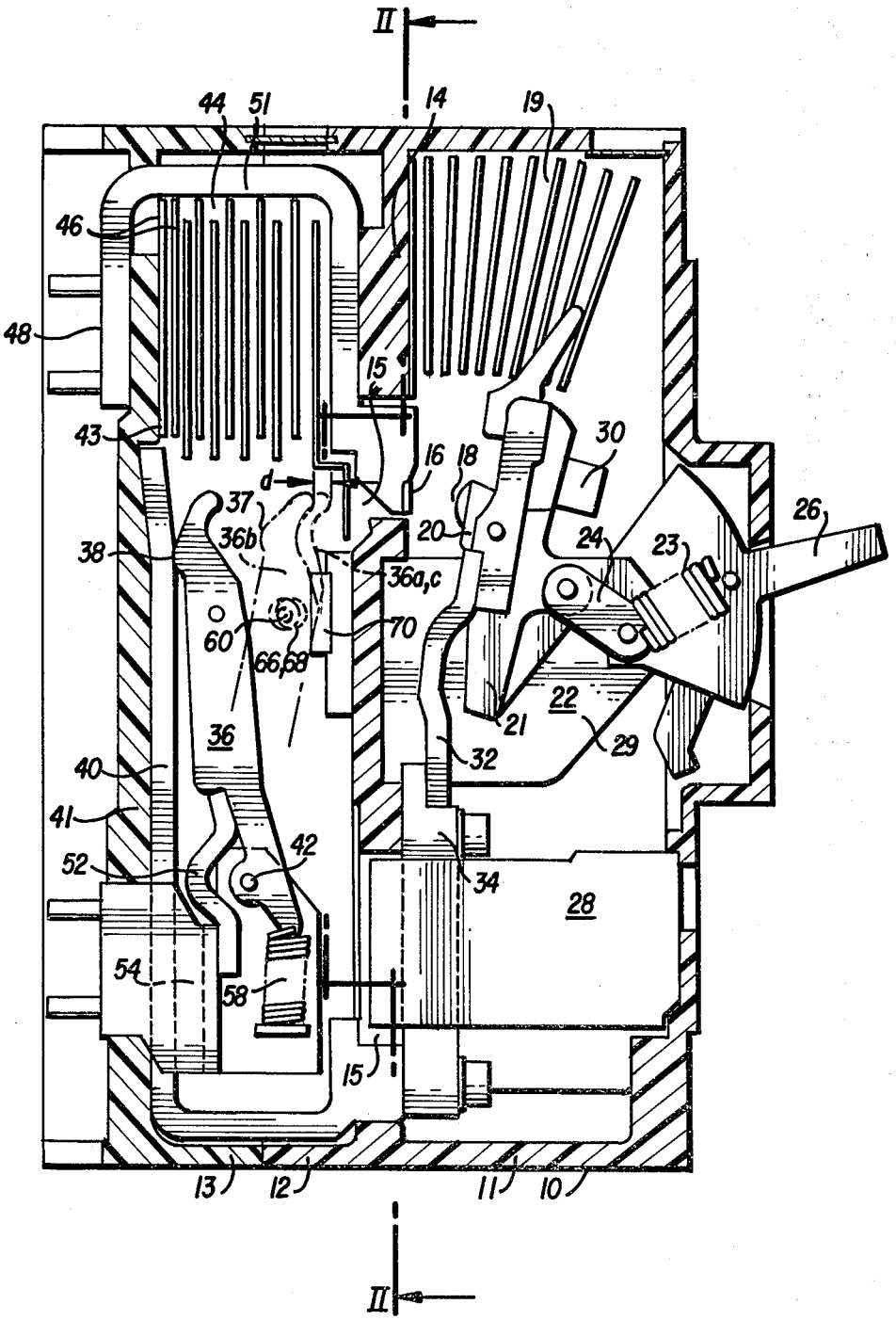
FIG. 1 is a view of a vertical section through a limiting circuit breaker equipped with a braking component according to the invention.
Figure 2:
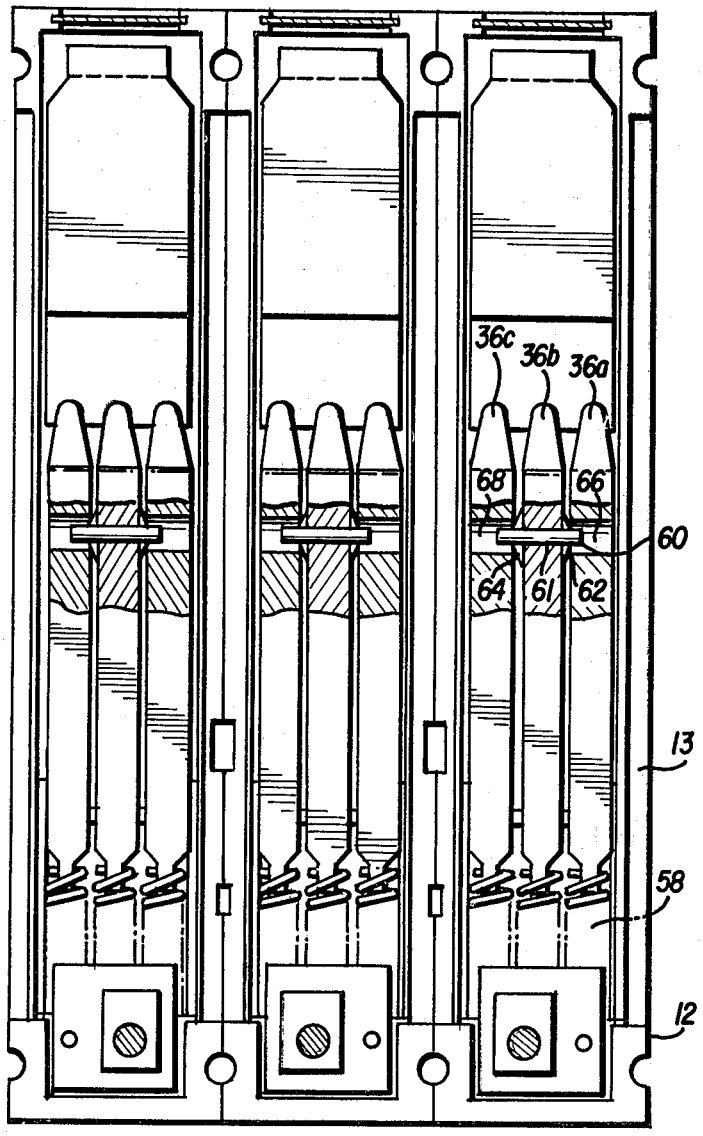
FIG. 2 is a view of a section along line II—II of FIG. 1.

On FIGS. 1 and 2, a low voltage, multipole limiting circuit breaker for high current ratings, such as of the order 1,000 Amperes, is made up of a standard circuit breaker unit 10 in a moulded insulating box 11 placed on top of a lower limiting unit 12 in a moulded insulating box 13 having the same dimensions of base plate. When boxes 11, 13 are assembled, for instance by fixing screws, the intermediate open back panel 14 forms a separating panel between the two units 11, 13 and has holes 15 through which the connecting conductors can be run.

Circuit breaker unit 10, of familiar design, has on each pole fixed contacts 16 arranged near back panel 14 and cooperating in the closed position with corresponding mobile contacts 18 carried by a number of pivoting fingers 20 housed in a cage 21. A breaking chamber 19 is provided in each pole and comprises a stack of metal separators to extinguish the arc drawn between contacts 16, 18 when they separate. An operating mechanism 22 with toggle mechanism 24 and energy storage spring 23 is fitted in the central part of box 11 and controls closing and opening of contact fingers 20, either by manual action of an external handle 26 or by interaction of a tripping unit 28 that causes automatic release of tripping lever 29 associated with mechanism 22 and entails opening of the circuit breaker in the case of a fault. Tripping unit 28 has an adjustable tripping threshold of the magneto-thermal or electronic type and is sensitive to overload or short-circuit circuits. It is placed lengthwise on the opposite side of mechanism 22 to breaking chamber 19. A cross bar 30 common to all the poles, lies in the transverse direction of the box and cooperates with operating mechanism 22 for the simultaneous actuation of the various adjacent cages 21 when manual or automatic control is effective. A connecting flex 32 forms the electrical connection between the rear of each contact finger 20 and a conducting strip 34 crossing tripping unit 28. A circuit breaker unit such as 10 is well known in the art and a detailed description of its design and operation will not be given here. Limiting unit 12 mounted against intermediate back panel 14 has three adjacent contact arms 36*a*, 36*b*, 36*c* per pole, each arm 36 having an elongated shape lying in the longitudinal direction of box 13 and parallel to contact fingers 20 of upper circuit breaker unit 10. One of the ends of each arm 36*a*, 36*b*, 36*c*, carries a mobile contact 37 cooperating in the closed position with a fixed contact 38 mounted on a fixed conductor 40 lying flat on the back panel 41 of box 13. The opposite end of arm 36*a*, 36*b*, 36*c*, is articulated on a swivel pin 42 oriented in the transverse direction of bar 30 and housed in box 13 between conductor 40 and the lower part of tripping unit 28. Conductor 40 extends beyond fixed contact 38 in the direction of an end plate 43 which is part of an arc extinguishing chamber 44 having deionizing plates 46 arranged under the breaking chamber 19 of circuit breaker unit 10. The opposite end of extended conductor 40 goes through hole 15 in back panel 14 and is fixed to strip 34 crossing tripping unit 28. When contacts 37, 38 of limiting unit 12 are in the closed position, each contact arm 36*a*, 36*b*, 36*c*, lies parallel and close to conductor 40 to form a large current loop subjected to electrodynamic repulsive forces when a short-circuit current occurs. A compression spring 58 placed opposite chamber 44 acts on each arm 36*a*, 36*b*, 36*c* to close contacts 37, 38. The line of action of spring 58 is practically perpendicular to the transverse direction of swivel pin (42) and the return force of spring 58 is applied to the end of arm 36 opposite mobile contact 37.

Connecting flex 52 forms the electrical connection between each mobile contact arm 36*a*, 36*b*, 36*c* and a first connecting terminal 50 by means of a perpendicular conductor 54 running through a hole provided in back panel 41. Lower conductor 40 runs through conductor 54 lengthwise. The second connection terminal 48 is fixed to a C-shaped linking conductor 51 running behind deionizing plates 46 of arc extinguishing chamber 44 in order to attract the arc drawn between contacts 37, 38. Linking conductor 51 goes through hole 15 in intermediate back panel 14 and connects to fixed contact 16 of the corresponding pole of circuit breaker 10. Note that the two connecting terminals 48, 50, of each pole of the limiting circuit breaker are mounted under the base back panel of limiting unit 12, so as to avoid current leadins through the side panels of boxes 11.

Each pole of limiting unit 12 is equipped with an inertiatype braking device which comes into action at the end of opening travel of contact arms 36*a*, 36*b*, 36*c*, to brake their fall into closed position by obstructing reclosure of contacts 37, 38 until circuit breaker unit 10 trips. Central contact arm 36*b*, is provided for this purpose with a lock-pin 60 held in a circular hole 61 by two lock-washers 62, 64, bearing on opposite faces of said arm 36*b*. Lock-pin 60 lies parallel to swivel pin 42 in the transverse direction of box 13 and its two opposite ends adjust into circular openings 66, 68, provided respectively in the two other adjacent side arms 36*a*, 36*c*, lying on either side of central contact arm 36*b*. Each opening 66, 68 has a diameter greater than that of lock-pin 60. The length of this pin is also shorter than the length of a pole. A raised part 70 projecting from the intermediate back panel 14 acts as a shock-absorber for the central contact arm 36*b* when it reaches the end of its opening travel.

The operation of each pole of the current limiting circuit breaker according to the invention is as follows:

With the limiting circuit breaker in the closed position, the current in each pole, enters, for instance, through connection terminal 48, goes through linking conductor 51 of limiting unit 12, closed contacts 16, 18 of circuit breaker unit 10, contact fingers 20, connecting flex 32 of connection strip 34, then conductor 40, closed contacts 38, 37 and contact arms 36*a*, 36*b*, 36*c*, of limiting unit 12, flexes 52, conductor 54 through back panel 41, and goes out through connection terminal 50. Operating mechanism 22 of the circuit breaker unit is now locked with actuating spring 23 in charged position.

In the event of overload or slight short circuit currents, limiting unit 12 is not operative and contacts 37, 38 remain closed due to the predominating action of contact pressure springs 58 compared with the weak electrodynamic repulsive forces acting between contact arms 36 and conductor 40. The fault is detected by tripping unit 28 which controls release of tripping lever 29 in mechanism 22, followed by opening of contacts 16, 18 of circuit breaker unit 10, and extinction of the arc in breaking chamber 19.

When a significant short-circuit current occurs, the electrodynamic tripping threshold of limiting unit 12 is overstepped and the electrodynamic repulsive forces acting on the swivel contact arms 36 override the action of springs 58. As a result, contacts 37, 38 open rapidly, limiting the current before operating mechanism 22 of circuit breaker unit 10 is called into action. Reclosing of contacts 37, 38 of limiting unit 12 during the short-circuit before final opening of contacts 16, 18 of circuit breaker unit 10, is prevented by the reaction of the inertia-type braking device that is actuated when the central contact arm 36*b* (dotted-dashed lines in FIG. 1) thrusts against the raised part 70 of the intermediate back panel 14. However, this blocking of the swing of central arm 36*b* at the end of the first opening phase, does not prevent the continued movement of side arms 36*a*, 36*c*, during idle travel, d, commenced during the second opening phase. This idle travel d ceases when holes 66, 68 of side fingers 36*a*, 36*c* (dashed lines FIG. 1) engage with lock-pin 60 of central arm 36*b*. The impact generated when central arm 36*b* comes up against raised part 70 tends to propulse central arm 36*b* back to the closed position. Due to the loose mechanical linkage of lock-pin 60 in holes 66, 68, the fall of central arm 36*b* is braked then reversed due to the inertia of side arms 36*a*, 36*c*, which act as compensating inertia blocks. The arrangement of springs 58 generates a low torque on contact arms 36*a*, 36*b*, 36*c*, at the onset of the return travel to closed position. The duration of opening of contact arms 36*a*, 36*b*, 36*c*, is longer than the response time of tripping unit 28, so that the fault will be definitely eliminated by circuit breaker unit 10 before limiting unit 12 recloses.

The invention is not restricted to the mode of construction described, but covers equally all alternative construction modes embodying equivalent electrotechnical provisions, in particular that in which a different number of contact arms 36*a*, 36*b*, 36*c* . . . may be adopted for limiting unit 12, and that in which the loose mechanical linkage for the inertiatype braking device may be achieved through a different design. This braking device has been described with respect to a modular limiting unit 12 in association with an independent circuit breaker unit 10 having an automatic tripping mechanism 28, but the braking device according to the invention naturally applies to any other limiting circuit breaker combining current limiting and current breaking functions in one and the same apparatus.

What is claimed is:

1. A multipole current limiting circuit breaker with an automatic tripping unit, each pole comprising:

a plurality of movable parallel contact arms, electrodynamic auto-repulsive means for imparting a substantially equal opening force to each of said contact arms under the effect of a sudden increase in current whereby each of the contact arms are repulsed simultaneously, spring means to urge said arms in the closed position, a lost motion mechanical linkage connecting a first of said contact arms with a second of said contact arms, abutment means cooperating only with the second contact arm for preventing the movement of the second contact arm beyond a predetermined position, said first contact arm being free to continue the opening movement beyond said abutment means by said lost motion linkage so that the inertia of the first contact arm compensates for the impact of the second arm on the abutment means and prevents immediate reclosure of the contact arms until such time as the tripping device is actuated.

2. A circuit breaker according to claim 1, said mechanical linkage comprising a lock-pin attached to said second arm so as to protrude laterally, said first arm having an opening through which extends with clearance said lock-pin to provide the lost motion mechanical linkage.

3. A circuit breaker according to claim 2, having three parallel contact arms, said lock-pin being secured to the intermediate contact arm to protrude on both sides for cooperation with the two other contact arms.

4. A circuit breaker according to claim 1, further comprising overload contacts electrically connected in series with said contact arms, said automatic tripping device provoking the opening of said overload contacts upon the occurrence of a predetermined overload, the reclosure of the contact arms being delayed until after the opening of said overload contacts.

* * * * *